US010577751B2

(12) United States Patent
Sánchez Jorrín

(10) Patent No.: US 10,577,751 B2
(45) Date of Patent: Mar. 3, 2020

(54) OPERATING AND LOCKING MECHANISM FOR DIAMOND CROSSINGS OF CENTRAL RAIL-GUIDED VEHICLES

(71) Applicants: JEZ SISTEMAS FERROVIARIOS, S.L., Llodio, Alava (ES); VOESTALPINE VAE GMBH, Vienna (AT)

(72) Inventor: Juan Carlos Sánchez Jorrín, Alava (ES)

(73) Assignees: JEZ SISTEMAS FERROVIARIOS, S.L., Llodio Alava (ES); VOESTALPINE VAE GMBH, Vienna (AT)

( * ) Notice: Subject to any disclaimer, the term of this patent is extended or adjusted under 35 U.S.C. 154(b) by 266 days.

(21) Appl. No.: 15/580,022

(22) PCT Filed: Jun. 3, 2016

(86) PCT No.: PCT/ES2016/070416
§ 371 (c)(1),
(2) Date: Dec. 6, 2017

(87) PCT Pub. No.: WO2016/198711
PCT Pub. Date: Dec. 15, 2016

(65) Prior Publication Data

US 2018/0171562 A1 Jun. 21, 2018

(30) Foreign Application Priority Data

Jun. 8, 2015 (EP) ..... 15382300

(51) Int. Cl.
*E01B 7/28* (2006.01)
*E01B 25/28* (2006.01)
(Continued)

(52) U.S. Cl.
CPC ..... *E01B 7/28* (2013.01); *B61B 13/00* (2013.01); *B61L 5/02* (2013.01); *B61L 5/10* (2013.01);
(Continued)

(58) Field of Classification Search
CPC ..... E01B 7/00; E01B 7/02; E01B 7/10; E01B 7/12; E01B 7/14; E01B 7/16; E01B 7/18; E01B 7/28; E01B 7/30
See application file for complete search history.

(56) References Cited

U.S. PATENT DOCUMENTS 1,344,866 A * 6/1920 Coulter ..... E01B 7/00 246/375
1,956,021 A * 4/1934 Goodaire ..... E01B 7/28 246/460
(Continued)

FOREIGN PATENT DOCUMENTS

DE 202007003459 U1 7/2008
ES 2398565 A1 3/2013
(Continued)

OTHER PUBLICATIONS

International Search Report and Written Opinion dated Aug. 31, 2016, from the corresponding PCT/ES2016/070416.

*Primary Examiner* — Robert J McCarry, Jr.
(74) *Attorney, Agent, or Firm* — Katten Muchin Roseman LLP

(57) ABSTRACT

The present invention relates to an operating and locking mechanism for diamond crossings of central rail-guided vehicles, comprising:

a sliding plate (2A) fixed to a fixed part (2) of the diamond crossing forming a channel in its central area in the direction of the X axis, a guide block (10) fixed to the sliding plate (2A) comprising four guide grooves (10A, 10B, 10C, 10D) in the
(Continued)

form of circular sectors located on the main plane of the guide block (10), the geometric center of which coincides with a theoretical pivoting point (17) of a moving panel (6) of the diamond crossing, where the sliding plate (2A) and the guide block (10) form a rectangular section groove (2F) the axis of which is parallel to the direction of the X axis, four shafts (12A, 12B, 13A, 13B) fixed to the moving panel (6) symmetrically with respect to a guide rail (7) of said moving panel (6) and perpendicular to the main plane of the moving panel (6), comprising respective rollers (12E, 12F, 13E, 13F) that can be moved and rolled respectively within the guide grooves (10A, 10B, 10C, 10D), and a cam plate (14) sliding in the longitudinal direction within the groove (2F) formed by the sliding plate (2A) and the guide block (10).

6 Claims, 10 Drawing Sheets

(51) Int. Cl.

| | |
|---|---|
| ***E01B 7/08*** | (2006.01) |
| ***B61L 5/02*** | (2006.01) |
| ***B61L 23/00*** | (2006.01) |
| ***B61L 5/10*** | (2006.01) |
| ***B61B 13/00*** | (2006.01) |

(52) U.S. Cl.

CPC ..... *B61L 23/002* (2013.01); *E01B 7/08* (2013.01); *E01B 25/28* (2013.01); *E01B 2202/02* (2013.01)

(56) References Cited

U.S. PATENT DOCUMENTS

| | | | | |
|---|---|---|---|---|
| 2,285,559 | A * | 6/1942 | Blair | E01B 7/00 246/378 |
| 2,294,793 | A * | 9/1942 | Monroe | E01B 7/00 246/380 |
| 5,245,929 | A * | 9/1993 | Wertz | B61J 1/04 104/29 |
| 8,051,777 | B2 * | 11/2011 | Weissbrodt | B61J 1/02 104/102 |
| 2008/0216701 | A1 * | 9/2008 | Wertz | B61J 1/04 104/35 |

FOREIGN PATENT DOCUMENTS

| | | | |
|---|---|---|---|
| FR | 2368577 | A1 | 5/1978 |
| FR | 2878488 | A1 | 6/2006 |
| FR | 2880636 | A1 | 7/2006 |
| JP | S50119170 | U | 9/1975 |
| JP | 2000064205 | A | 2/2000 |

* cited by examiner

OPERATING AND LOCKING MECHANISM FOR DIAMOND CROSSINGS OF CENTRAL RAIL-GUIDED VEHICLES

TECHNICAL FIELD OF THE INVENTION

The present invention relates to an operating and locking mechanism for diamond crossings of central rail-guided vehicles, applied in the industry of guided vehicles.

BACKGROUND OF THE INVENTION

A central rail-guided vehicle is a vehicle usually made up of a plurality of wagons and circulating on rubber tires, which bear the weight of the vehicle and provide it with the tractive and braking efforts required in traffic. The surface on which these vehicles circulate is generally urban streets but on exclusive roadways, similar to tramways.

A specially-shaped central rail is arranged embedded in the surface for guiding said vehicles. Two railway-type wheels assembled in one and the same truck or bogie in the vehicle such that their axles form an angle of about 90° are supported on said rail. The arrangement of said wheels and the special shape of the central rail are what guide the vehicle, such that said vehicle must follow the path marked by said central rail. For the guiding to be effective four trucks or bogies are arranged for each wagon of the vehicle, said trucks or bogies having a pivoting arrangement with respect to the body of the wagon similar to the wagons of a railway or tramway.

Like tramway or railway vehicles, these central guide systems have railway layouts such as turnouts and diamond crossings. Diamond crossings are the railway layout where two tracks cross or intersect one another, in the case of central rail-guided vehicles they are the railway layout where two guide rails cross or intersect one another. Said diamond crossings are generally embedded in the surface.

Given that these systems are conceived for being installed in the urban layout, the radii of the curves in which the vehicles must be inscribed are generally smaller than the radii of the curves of common railway vehicles, as occurs in the case of tramways. This means that like in the case of tramways, the angles of the diamond crossings for central rail-guided vehicles are greater than those corresponding to railway operations.

The fact that the central guide rail is simultaneously active on both sides of the head provides diamond crossings intended for central rail-guided vehicles with a different configuration with respect to diamond crossings of railway or even tramway. Due to this characteristic of the central guide rail, in diamond crossings intended for vehicles of this type there can be no voids, i.e., interruptions in the guide rail, given that guiding must be continuous.

Diamond crossings with a pivoting central panel have been used today for the purpose of meeting the preceding requirement. In this type of railway layout, the central panel consists of a guide rail on a platform that can rotate the angle required for selectively connecting either two branches corresponding to a first route or two branches corresponding to a second route. Both routes cross each another at the central point of the diamond crossing.

The problem with this railway layout results from the fact that the rotating shaft of the central panel is located precisely below said central panel, such that accessibility thereto is complex when performing inspection or maintenance tasks.

Additionally, in central rail-guided systems it is common, for safety and maintenance reasons, for the mechanical system made up of the railway layout, in this case the diamond crossing, the control system, i.e., the drive motor, and the locking system to be required to not invade the area of the surface intended for the rolling of rubber tires. This means that both the control system and the locking system must be as compact as possible, which on the other hand complicates maintenance and inspection.

DESCRIPTION OF THE INVENTION

The present invention relates to an operating and locking mechanism for diamond crossings of central rail-guided vehicles, which allows solving the problems of the state of the art.

To that purpose, the mechanism proposed by the invention is defined in claim 1. Advantageous embodiments of the invention are defined in the dependent claims.

The mechanism of the invention solves the maintenance problem of the mechanical system formed by the railway layout, the control system and the locking system, as a result of having very restricted space available for said system.

Another additional advantage provided by the invention is the fact that it incorporates the locking functionality. This is achieved by mechanically fixing the moving part of the diamond crossing in its end positions, such that its involuntary or spontaneous movement as a result of the passage of traffic through any of the two routes of said diamond crossing is not possible. The mechanism object of the present invention thereby adds an advantage from the safety viewpoint in diamond crossing control, thus preventing possible accidents when the rail of the pivoting central panel is in an incorrect intermediate position, which can cause the guide wheels to derail, with the subsequent serious accident this can cause.

The mechanism of the present invention is also very compact from a constructive viewpoint, which allows integrating said mechanism with the drive motor, within the casing or fixed part of the diamond crossing, which ends up having restrained dimensions. As previously mentioned, it is a necessary requirement for the system formed by the diamond crossing and its drive to not invade the area of the roadway intended for the rolling of the rubber tires of central rail-guided vehicles.

Finally, it must be pointed out that the operating and locking mechanism of the present invention has a low life cycle cost. It furthermore allows easy accessibility for the purpose of carrying out in a simple manner inspection, assembly, disassembly, element replacement and maintenance tasks.

DESCRIPTION OF THE DRAWINGS

To complement the description that is being made and for the purpose of aiding to better understand the features of the invention according to a preferred practical embodiment thereof, a set of drawings is attached as an integral part of said description in which the following has been depicted with an illustrative and non-limiting manner.

PREFERRED EMBODIMENT OF THE INVENTION

Figure 1:
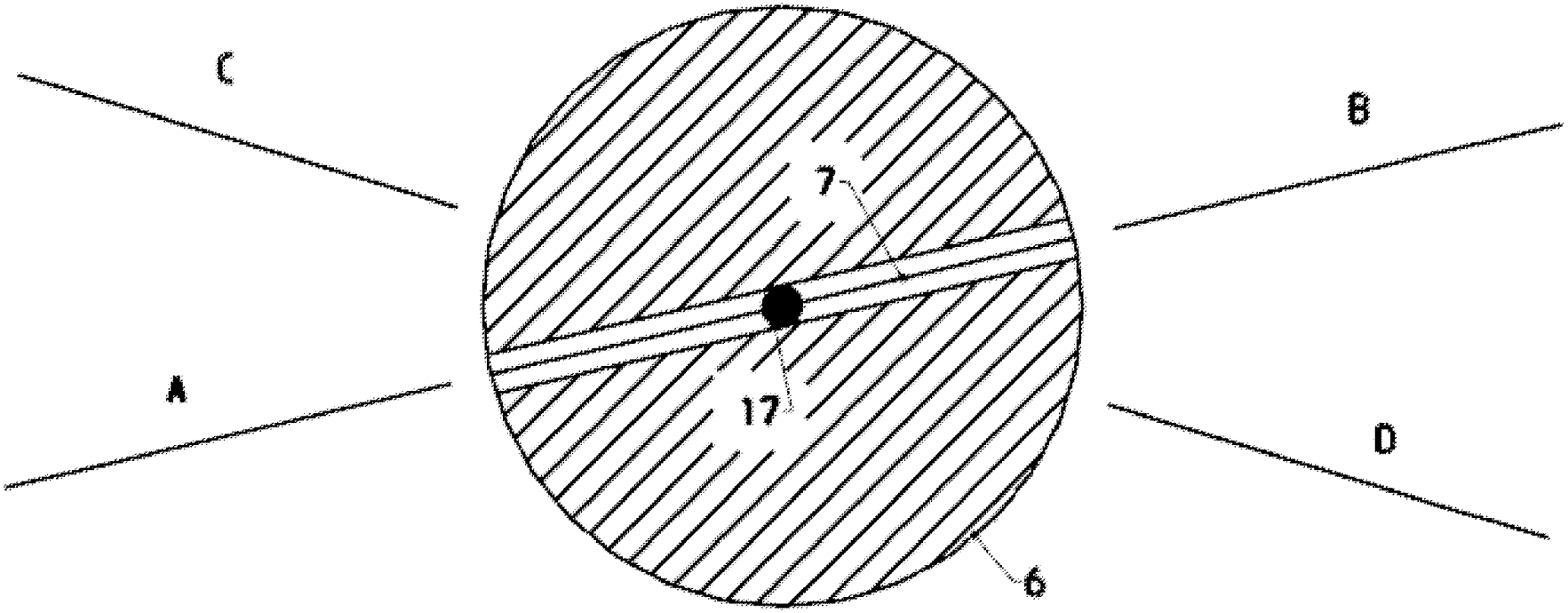
FIG. 1 shows a schematic plan view of one embodiment of a diamond crossing of central rail-guided vehicles providing passage through a first route AB of two possible routes.

An embodiment of the mechanism object of the invention is described in view of the mentioned drawings, in which a diamond crossing with two straight routes that cross one another is depicted, the invention being applicable for other route geometries and various crossing angles.

The planes parallel to the XY plane defined in the drawings are defined therein as the main planes of the components. The plan views correspond to the direction perpendicular to the XY plane, and Z axis perpendicular to the XY plane, increasing heights corresponding to increasing values of Z.

Direction X is parallel to the bisector corresponding to the angle formed by the first route AB and the second route CD of the diamond crossing, both taken as straight routes, the direction of increase of the value of the X coordinate being towards the part where the drive motor is installed.

A preferred embodiment of the mechanism object of the present invention is described below.

The diamond crossing for central rail-guided vehicles comprises a fixed part or element (2), also referred to as casing, prepared for being embedded in the surface of the street, the upper part of the diamond crossing being flush with the surface. In said casing (2) there are housed the main elements of the diamond crossing as well as the drive motor, additionally serving as a support for the fixed rails (3A, 3B) of the first route AB and the fixed rails (4C, 4D) of the second route CD.

The fixed element (2) comprises removable protective covers (2C, 2D, 2D', 2E) bolted into the upper part thereof, flush with the roadway. Said protective covers (2C, 2D, 2D', 2E) protect a moving panel or element (6) and the mechanism itself, in addition to allowing access to said elements to perform cleaning and maintenance tasks. The protective covers (2C) also serve as element preventing lifting of the moving panel (6) fixing the upward vertical movement of said moving panel (6) which can be caused due to the actions of the guide wheels (9) themselves.

It is contemplated that the fixed element (2) comprises water drainage conduits in the lower part thereof, not depicted in the drawings, and it can also house the heating elements required for operating the diamond crossing in the winter. According to a preferred embodiment, the fixed element (2) is made of steel and built by mechanical welding and is protected against corrosion by means of treatments such as zinc coating or antioxidant priming.

Figure 2:
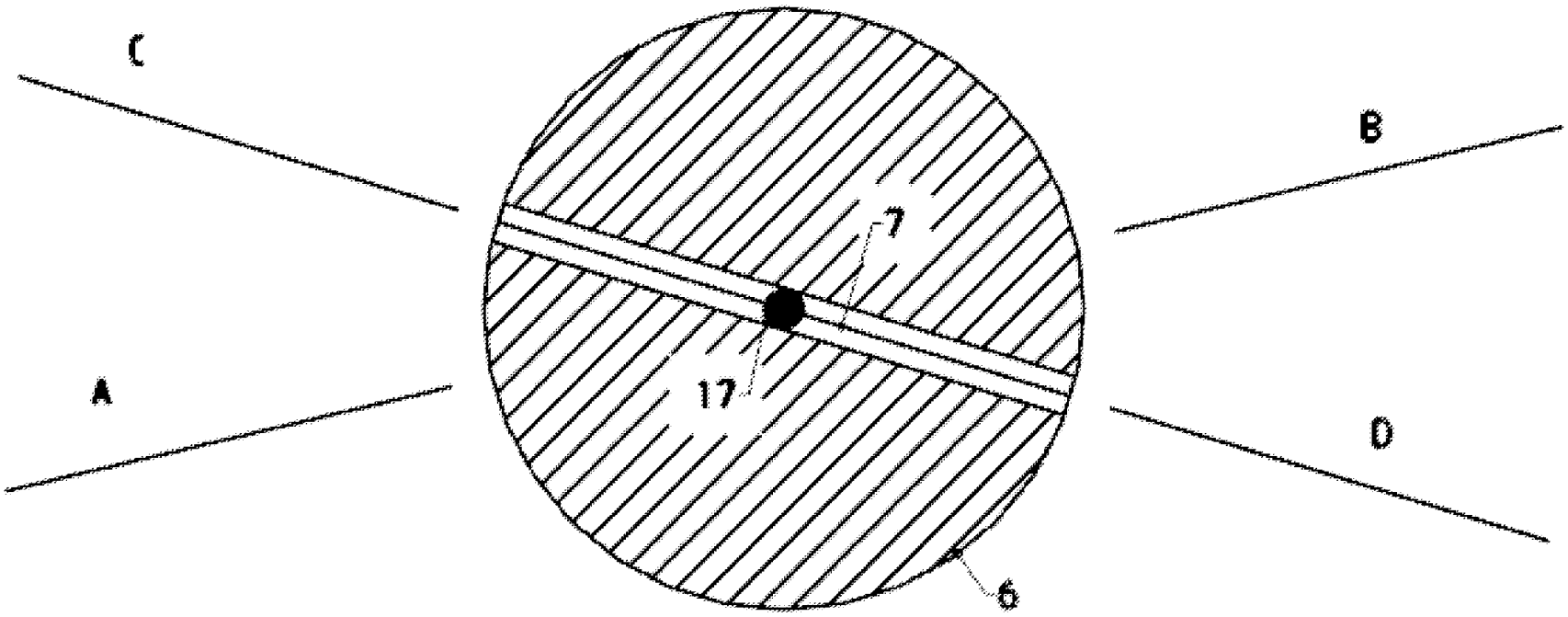
FIG. 2 shows a schematic plan view of the embodiment of the diamond crossing depicted in FIG. 1, providing passage through a second route CD of the two possible routes.
Figure 3:
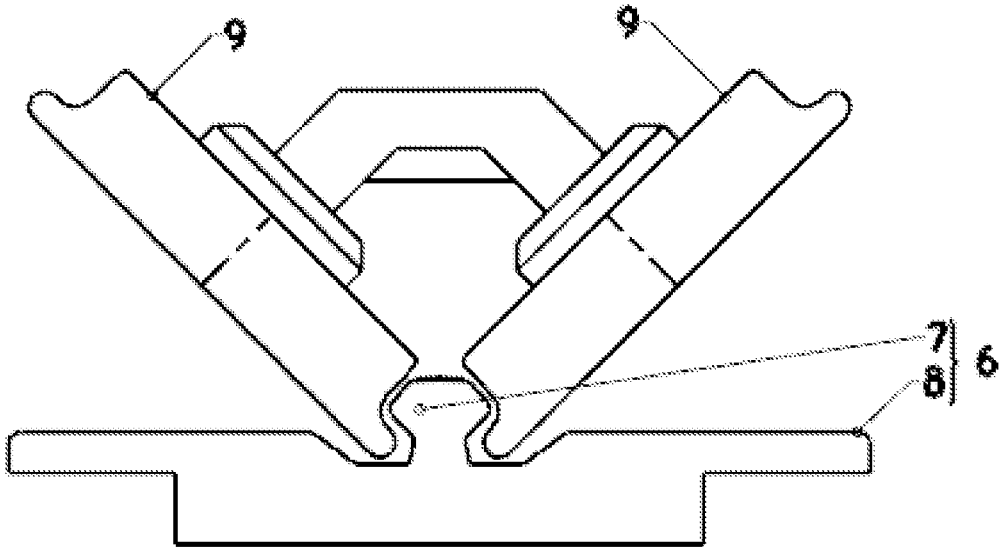
FIG. 3 shows a cross section of the guide rail of the moving central panel of the diamond crossing, showing the two guide wheels travelling on said rail, and where the bogie has not been depicted for greater clarity.
Figure 4:
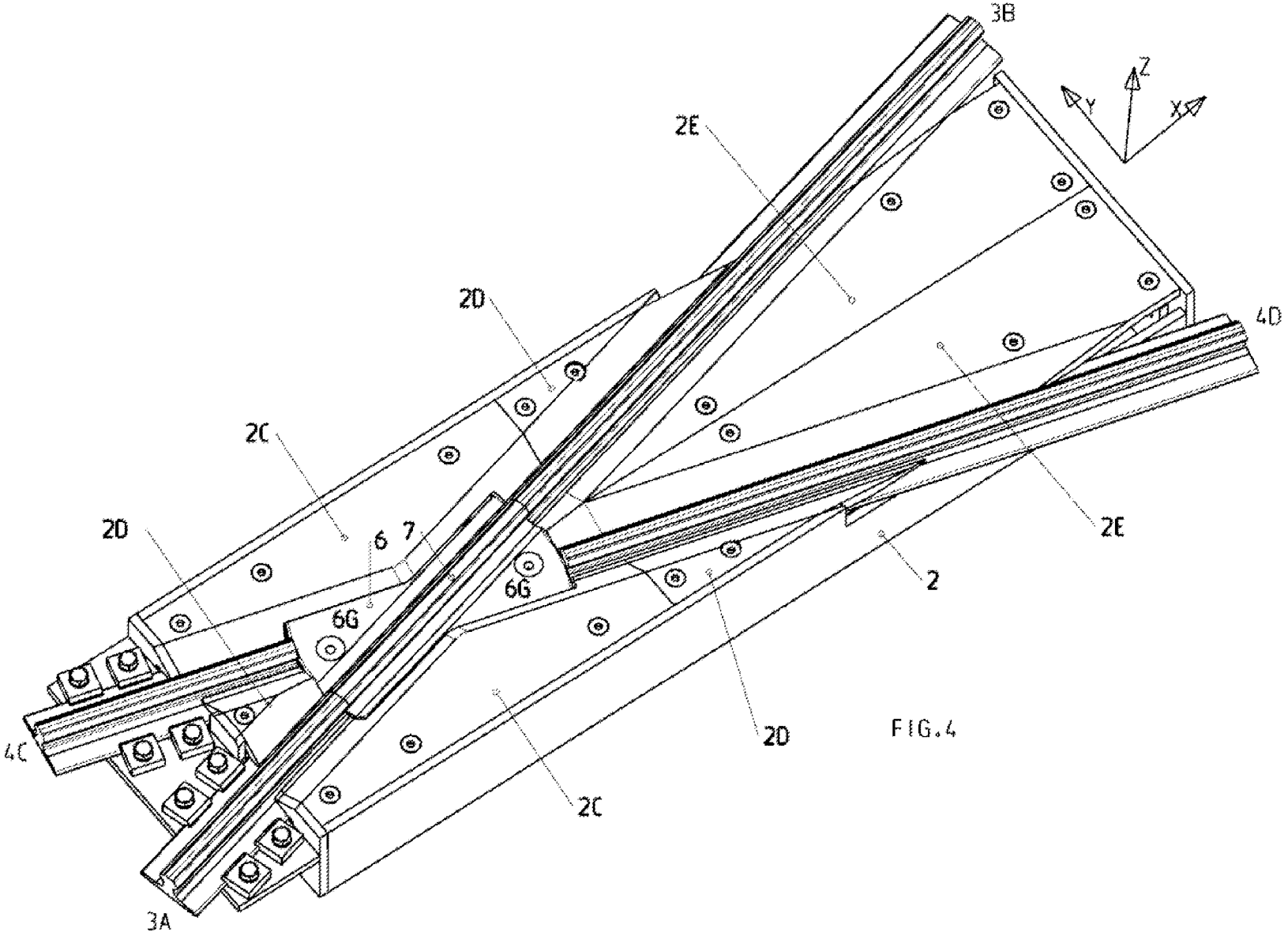
FIG. 4 shows a perspective view of a diamond crossing of central rail-guided vehicles equipped with the operating and locking mechanism object of the invention, providing passage through the first route AB.
Figure 5:
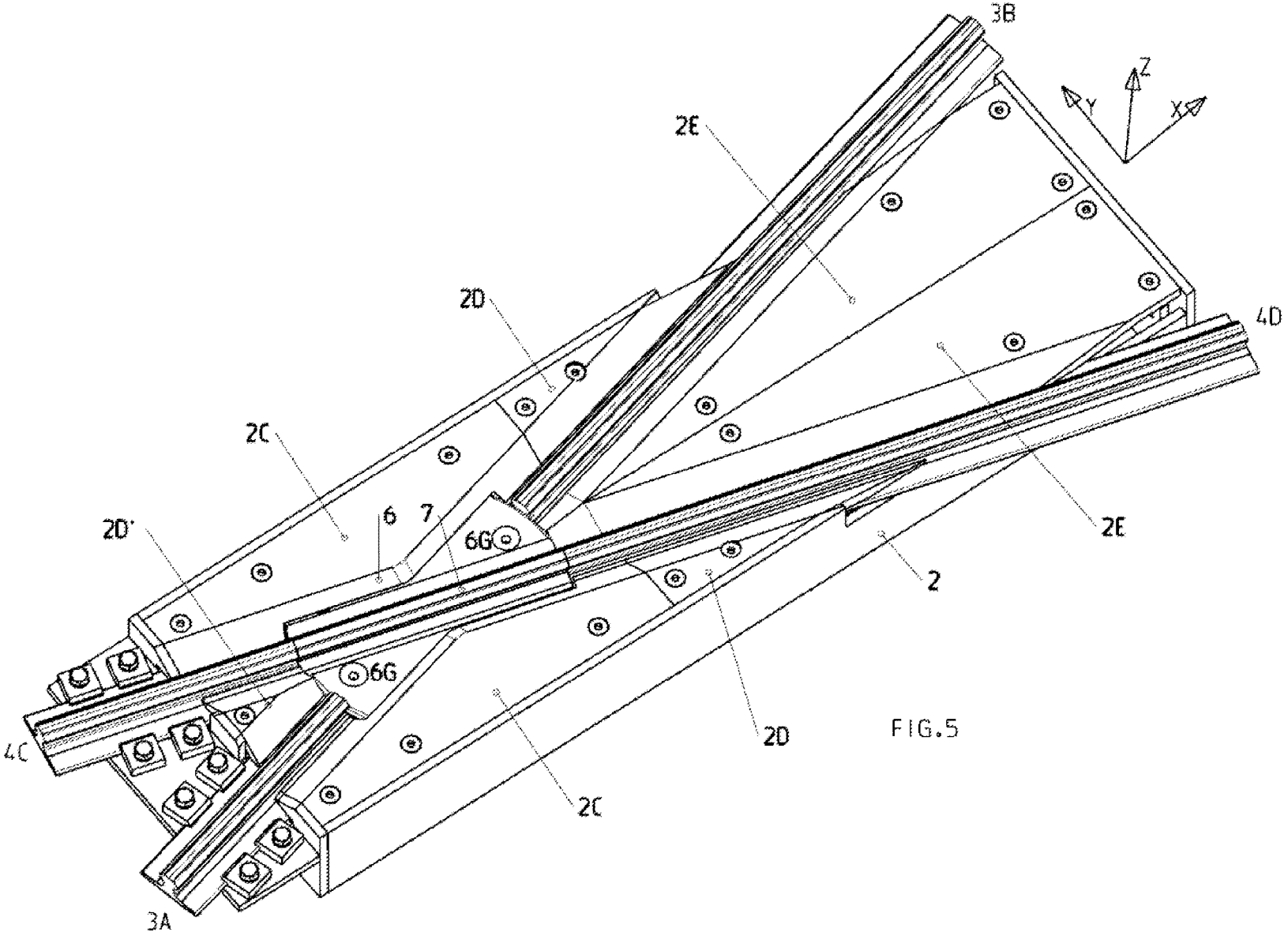
FIG. 5 shows a perspective view of the diamond crossing with the mechanism of the invention depicted in FIG. 4, providing passage through the second route CD.
Figure 6:
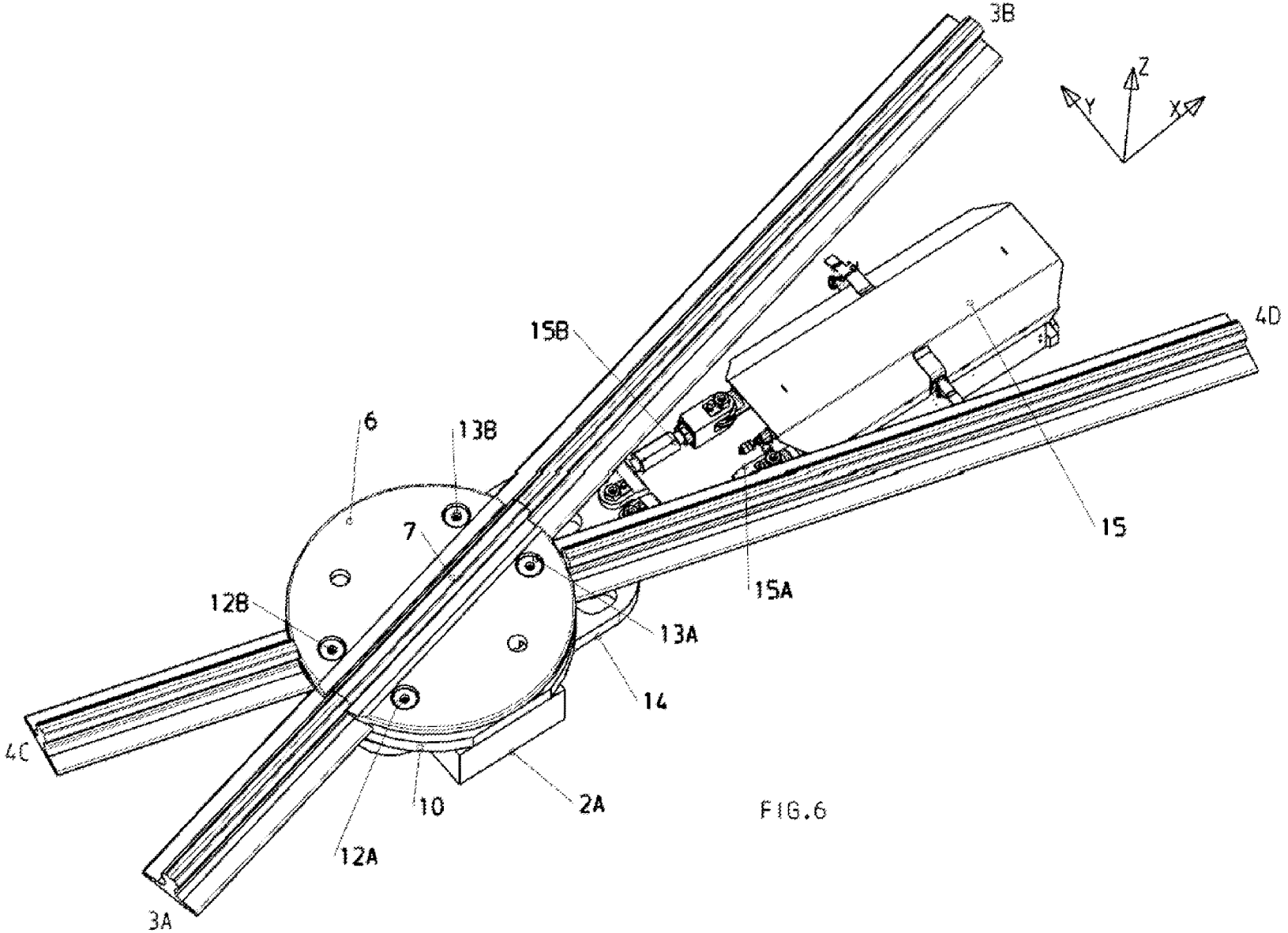
FIG. 6 shows a perspective view of the diamond crossing with the mechanism of the invention depicted in FIG. 4, but without the casing and its protective covers.
Figure 7:
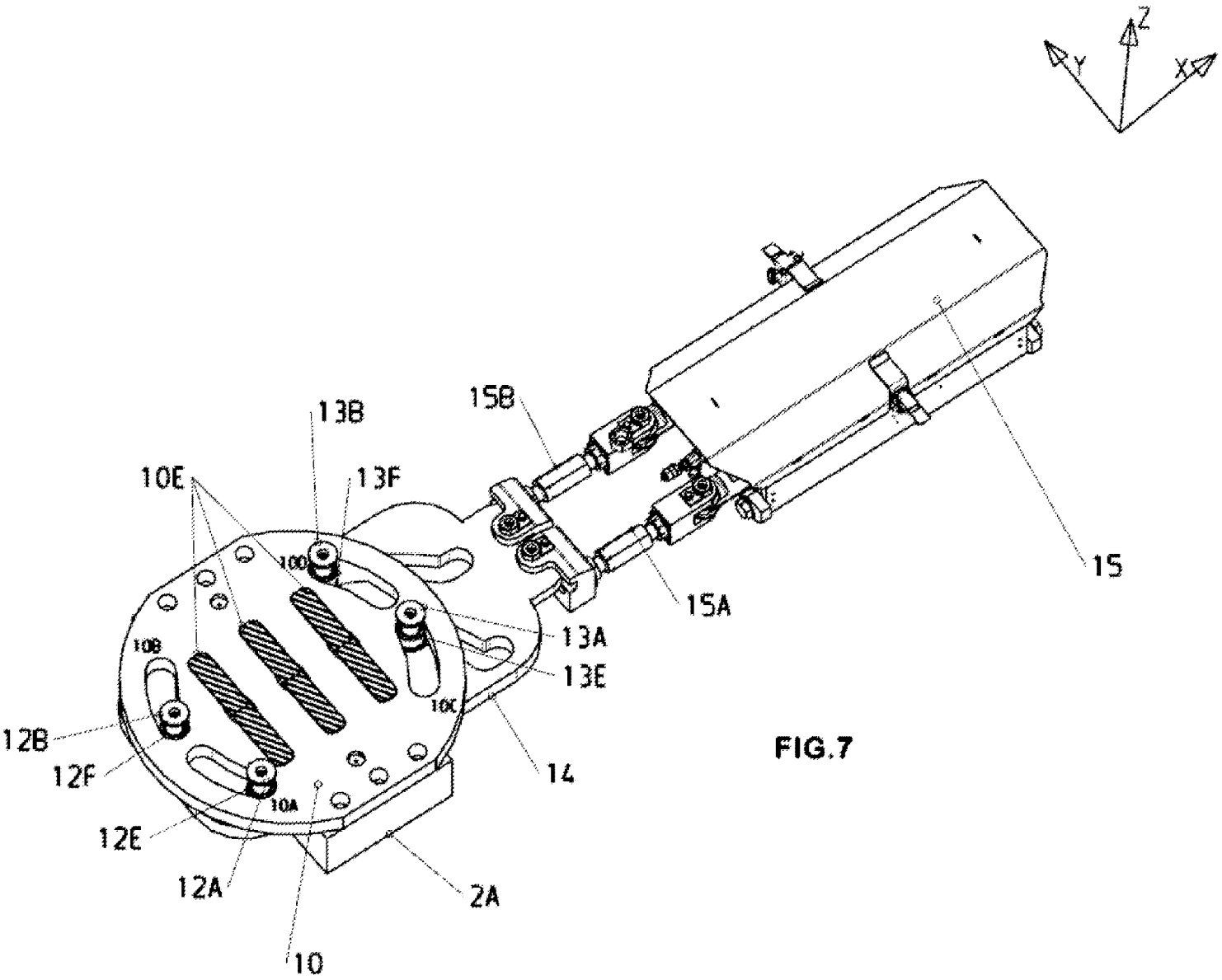
FIG. 7 shows a perspective view like the one in FIG. 6, but without the casing, its protective covers and without the moving panel.
Figure 8:
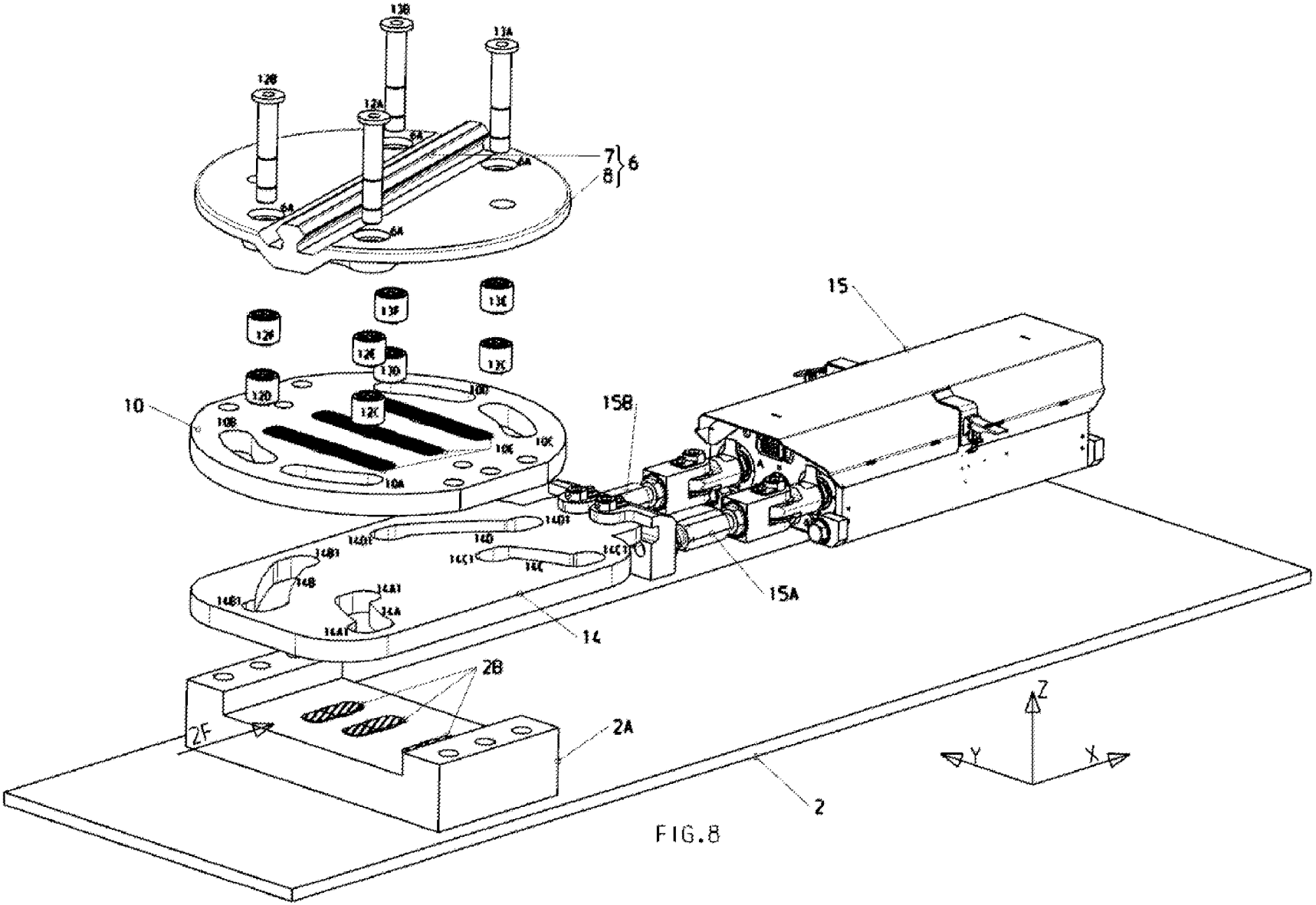
FIG. 8 shows an exploded view of the mechanism of the invention as depicted in FIG. 7.
Figure 9:
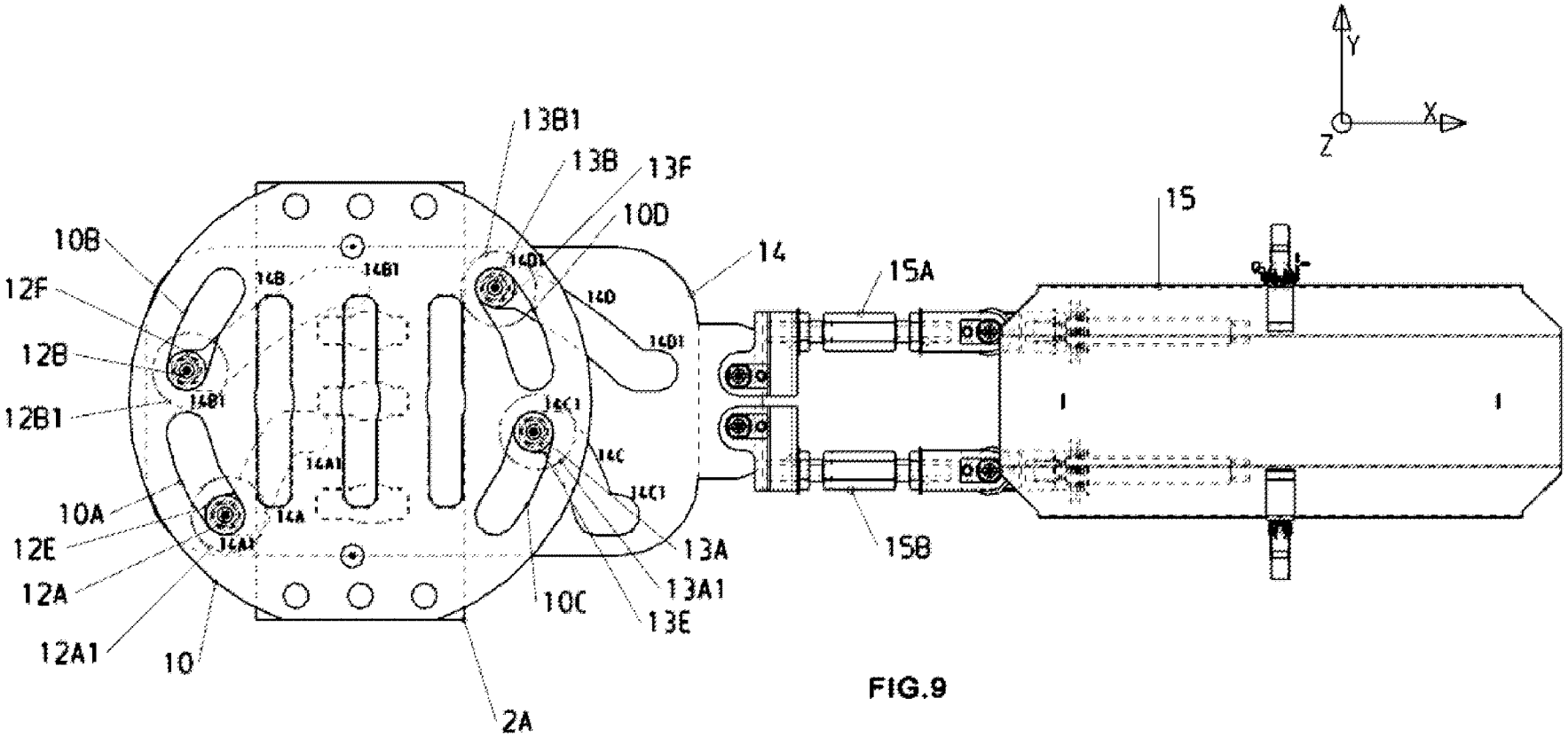
FIG. 9 shows a plan view of the mechanism of the invention in its end position corresponding to the first route AB, without having depicted the moving panel.
Figure 10:
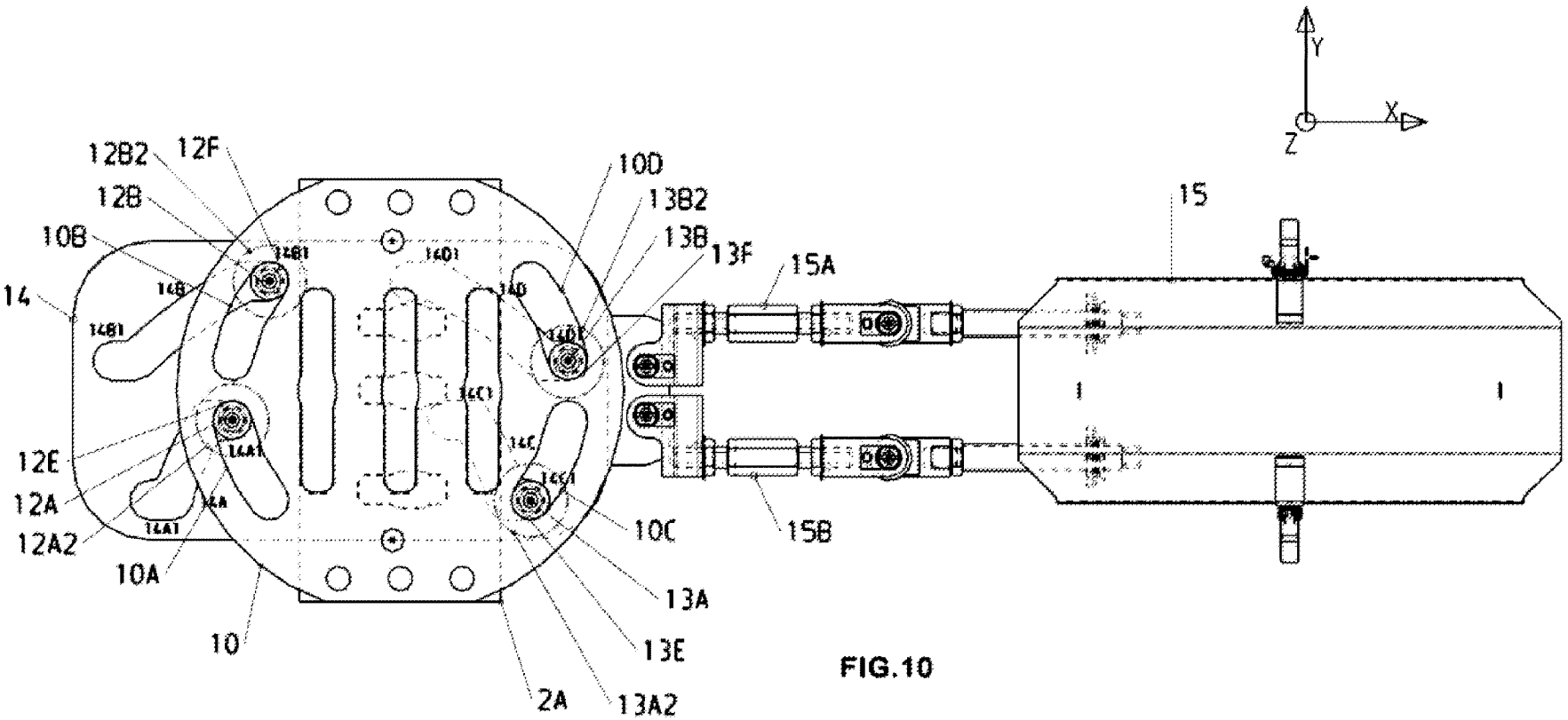
FIG. 10 shows a plan view of the mechanism of the invention in its end position corresponding to the second route CD, likewise without having depicted the moving panel.

In turn, the moving element (6) comprises, as a main constituent part, a guide rail (7) assembled in a base plate (8). According to a preferred embodiment, the moving element (6) is circularly symmetric and can pivot around its geometric center (17), depicted in FIGS. 1 and 2, selectively and alternatively reaching a position for passage through the first route AB, depicted in FIG. 1, or a position for passage through the second route CD, depicted in FIG. 2. Said routes correspond with the alignment of the moving guide rail (7) with the fixed rails (3A, 3B) for the first route AB and with the alignment of the moving guide rail (7) with the fixed rails (4C, 4D) for the second route CD. In both cases, continuous and safe routes are established for the pair of central guide wheels (9), depicted in FIG. 3, assembled in a common truck, not depicted in said drawing for greater clarity. The moving element (6) pivots and is supported on a guide block (10). The guide block (10) is assembled on a sliding plate (2A) by means of bolted attachments. This sliding plate (2A) is attached to the fixed element (2) at the base thereof by means of welding or bolted attachments. A cam plate (14) slides in the longitudinal direction defined by the X axis on the sliding plate (2A). Said cam plate (14) is confined between the sliding plate (2A) and the guide block (10) in a rectangular section groove (2F) the dimensions of which are slightly greater than the section of the cam plate (14) so that the cam plate (14) is perfectly guided in its longitudinal movement in the direction of the X axis in said groove (2F). The groove (2F) is made up of the U shape of the sliding plate (2A) and the guide block (10) that is bolted to said sliding plate (2A).

In order to prevent greasing, the sliding plate (2A) can optionally be equipped with, for example, Teflon or polyamide inserts (2B) on the upper surface therefore on which the cam plate (14) of the diamond crossing slides or with antifriction coatings such as molybdenum or others.

Also, and for the purpose of preventing greasing, the guide block (10) can optionally be equipped, for example, with Teflon or polyamide inserts (10E) on the upper surface thereof on which the moving panel or element (6) of the diamond crossing pivots or with antifriction coatings such as molybdenum or others.

The moving element (6) can be built by mechanical welding, with a guide profile (7) of pearlite steel rail attached by welding or nuts and bolts to a structural steel base plate (8), or it is preferably in a monoblock configuration, i.e., cast and machined in a single part. This allows extraordinary design flexibility and the use of wear-resistant steels such as the austenitic manganese steel or others.

The moving element (6) comprises four fitted boreholes (6A), two on each side of the guide profile (7), in which shafts (12A, 12B, 13A, 13B) guiding the pivoting movement of the moving element (6) during the operation thereof are inserted.

The rotation of the moving panel or element (6) with respect to the pivoting point (17) is generated by means of the mechanism of the present invention.

The mechanism comprises the guide block (10) of the moving panel (6) which is fixed to the sliding plate (2A) of the diamond crossing by means of bolted attachments is made of wear-resistant steel.

In the guide block (10) there are four guide grooves (10A, 10B, 10C, 10D) in the form of circular sectors having the same radius, the center of said grooves being the theoretical pivoting point (17) of the moving panel (6) of the turnout.

The moving panel (6) has fixed thereto through the boreholes (6A) four shafts (12A, 12B, 13A, 13B) perpendicular to the sliding plane of said panel, equipped respectively with rollers (12E, 12F, 13E, 13F) that can be moved and rolled within the guide grooves (10A, 10B, 10C, 10D) of the guide block (10). The diameter of said rollers (12E, 12F, 13E, 13F) is slightly less than the width of the guide grooves (10A, 10B, 10C, 10D) in order to assure correct guiding. To make maintenance easier, said shafts have greasers in their upper part and conduits for greasing the bearings of the rollers (12E, 12F, 13E, 13F). Greasing and inspection of the shafts (12A, 12B, 13A, 13B) can be done by removing the covers (6G) screwed to the moving element (6). According to a preferred embodiment, the rollers have sealed bearings and are preferably made from wear-resistant steel. Therefore, the moving panel (6) of the diamond crossing can pivot on the guide block (10) around the theoretical point (17) being guided at the time of pivoting by the previously described grooves (10A, 10B, 10C, 10D) of the guide block (10).

The operating and locking mechanism object of the present invention patent is complemented with a cam plate (14) which slides in the longitudinal direction defined by the X axis in both directions guided by the groove (2F). Said cam plate (14) is made of high-strength, wear-resistant steel.

The cam plate (14) is equipped with four grooves (14A, 14B, 14C, 14D) in which the rollers (12C, 12D, 13C, 13D) attached respectively to the shafts (12A, 12B, 13A, 13B) of the moving panel (6) can be moved and rolled respectively. The diameter of said rollers is slightly less than the width of the grooves of the cam plate in order to assure correct guiding. Said rollers have sealed bearings and are preferably made from wear-resistant steel. Said rollers are at a lower level Z than the rollers (12E, 12F, 13E, 13F) rotating respectively on said shafts (12A, 12B, 13A, 13B). Greasing thereof is likewise done through the greasers of said shafts.

The shape of the grooves (14A, 14B, 14C, 14D) has been designed such that when the cam plate (14) slides in one direction or the other of the X axis in the groove (2F), the grooves (14A, 14B, 14C, 14D) of the cam plate (14) always form acute angles in relation to the grooves (10A, 10B, 10C, 10D) respectively of the guide block (10), such that the shafts (12A, 12B, 13A, 13B) and their respective rollers (12C, 12D, 13C, 13D) are driven by the longitudinal movement of the cam plate (14) and reach the end positions (12A1, 12B1, 13A1, 13B1) respectively, corresponding to the alignment of the guide rail (7) of the moving panel (6) with the fixed rails (3A, 3B) establishing route AB, or alternatively reach the end positions (12A2, 12B2, 13B2, 13B2) corresponding to the alignment of the guide rail (7) of the moving panel (6) with the fixed rails (4C, 4D) establishing route CD.

In the end positions (12A1, 12B1, 13A1, 13B1), the rollers (12E, 12F) reach the extreme end positions in the grooves (10A, 10B) respectively corresponding to a lower value of Y in said grooves, whereas the rollers (13E, 13F) reach the extreme end positions in the grooves (10C, 10D) respectively corresponding to a greater value of Y in said grooves.

In the end positions (12A2, 12B2, 13A2, 13B2), the rollers (12E, 12F) reach the extreme end positions in the grooves (10A, 10B) respectively corresponding to a greater value of Y in said grooves, whereas the rollers (13E, 13F) reach the extreme end positions in the grooves (10C, 10D) respectively corresponding to a lower value of Y in said grooves.

According to a preferred embodiment, the cam plate (14) is moved by means of a drive motor (15) through alternating linear movement of the drive rod (15A). The secure end positions of the cam plate (14) are checked by means of the detection rod (15B) attached to the drive motor. Both rods (15A, 15B) are made of structural steel and equipped with lugs and pins in order to be attached in an articulated manner to the cam plate (14). The pins have accessible greasers in their upper part in order to make maintenance thereof easier. The drive motor (15) is fixed to the casing (2) by means of bolted attachments, such that it does not experience relative movement with respect to said casing.

The grooves (14A, 14B, 14C, 14D) each have at their final ends two respectively circular-shaped notches (14A1, 14B1, 14C1, 14D1) having a diameter slightly greater than the rollers (12C, 12D, 13C, 13D). When the cam plate (14) reaches its two end positions, the rollers (12C, 12D, 13C, 13D) are fitted between the notches (14A1, 14B1, 14C1, 14D1) of the cam plate (14), such that the shafts (12A, 12B, 13A, 13B) are mechanically trapped, and therefore the moving panel (6) is mechanically locked in its end alignment position either for alignment of the rail (7) with route AB or alternatively of the rail (7) with route CD. In these end positions, and as a result of this mechanical locking system, spontaneous movement of the moving panel (6) due to external actions when the latter reaches its end positions is not possible.

The translational movement of the cam plate (14) in one direction or the other on the X axis thus causes the rotation of the moving panel or element (6) of the diamond crossing in one direction of rotation or another around the pivoting point (17).

The fact that the mechanism is compact and does not entail increasing the size of the diamond crossing in which it is applied, likewise allowing compact integration of the drive motor, thus preventing the invasion of the area of the roadway intended for the rubber tires of guided vehicles, can be highlighted among the advantages of the mechanism of the invention. It allows for a very flat design of the fixed part of the turnout given that not a lot of height is required for incorporating the mechanism.

The mechanism is accessible from the upper part of the diamond crossing by means of removing the protective covers. Therefore, the main elements of the mechanism can be inspected and accessed for cleaning and greasing. In the case of replacing elements that have broken down, the mechanism can be easily disassembled starting with the upper levels of the diamond crossing.

Furthermore, the mechanism has a mechanical locking functionality establishing safe routes through one guide rail or another.

On the other hand, the mechanism is compatible with various drive motors or manual control apparatus existing today.

The life cycle cost of the mechanism is low since it uses wear-resistant elements and rollers that replace friction with rolling, said rollers having sealed bearings to reduce the need for greasing and maintenance. Furthermore, both the moving element and the cam plate can slide on self-lubricated elements without a need for greasing, such as Teflon films, polyamide films or molybdenum coatings.

The preferred configuration of the invention herein described is applied to diamond crossings the two routes of which are straight, though this is not a limiting factor since the operating and locking mechanism herein described can be applied to other types of diamond crossings of various angles and with one or two of the routes being curved.

In view of this description and set of drawings, the person skilled in the art will understand that the embodiments of the invention that have been described can be combined in many ways within the object of the invention. The invention has been described according to several preferred embodiments thereof, but for the person skilled in the art it will be obvious that multiple variations can be made to said preferred embodiments without exceeding the object of the claimed invention.

The invention claimed is:

1. Operating and locking mechanism for diamond crossings of central rail-guided vehicles, in which the diamond crossing comprises a fixed part (2), a pivoting moving panel (6) in which there are provided a guide rail (7), a fixed guide rail (3A) forming a first route AB with a fixed guide rail (3B), a fixed guide rail (4C) forming a second route CD with a fixed guide rail (4D), the rails (3A, 3B, 4C, 4D) being attached to the fixed part (2), such that the moving panel (6) is circularly symmetric and rotates about its theoretical center (17), such that the moving panel (6) selectively and alternatively allows passage through the first route AB or through the second route CD, when the guide rail (7) of the moving panel (6) is selectively aligned with the fixed rails (3A, 3B) of the first route AB or with the fixed rails (4C, 4D) of the second route CD, characterized in that the mechanism comprises:

a sliding plate (2A) fixed to the fixed part (2), forming a channel in its central area in the direction of the X axis, a guide block (10) fixed to the sliding plate (2A), comprising four guide grooves (10A, 10B, 10C, 10D) in the form of circular sectors located on the main plane of the guide block (10), the geometric center of which coincides with the theoretical pivoting point (17) of the moving panel (6), where the sliding plate (2A) and the guide block (10) form a rectangular section groove (2F) the axis of which is parallel to the direction of the X axis, four shafts (12A, 12B, 13A, 13B) fixed to the moving panel (6) symmetrically with respect to the guide rail (7) and perpendicular to the main plane of the moving panel (6), comprising respective rollers (12E, 12F, 13E, 13F) that can be moved and rolled respectively within the guide grooves (10A, 10B, 10C, 10D), and a cam plate (14) sliding in the longitudinal direction within the groove (2F) formed by the sliding plate (2A) and the guide block (10), and comprising four grooves (14A, 14B, 14C, 14D) located on the main plane of the plate (14) within which the rollers (12C, 12D, 13C, 13D) which are attached and rotate respectively on shafts (12A, 12B, 13A, 13B) can be moved and rolled respectively, said rollers (12C, 12D, 13C, 13D) being at a lower level Z with respect to the rollers (12E, 12F, 13E, 13F)

where the cam plate (14) is moved in the direction of the X axis by a drive motor (15) through linear movement in one direction or the other of a drive rod (15A), such that the linear movement in one direction or the other of the drive motor (15) through the drive rod (15A) is converted into rotational movement in one direction or the other of the moving panel (6) around the point (17), such that in the end positions thereof the moving panel (6) is locked and the guide rail (7) is aligned in a secure manner selectively with either the first route AB or with the second route CD.

2. Mechanism according to claim 1, wherein the shape of the grooves (14A, 14B, 14C, 14D) is such that when the cam plate (14) slides in one direction or the other of the X axis in the groove (2F), the grooves (14A, 14B, 14C, 14D) of the cam plate (14) always form acute angles in relation to the grooves (10A, 106, 10C, 10D) respectively of the guide block (10), such that the shafts (12A, 12B, 13A, 13B) and their respective rollers (12C, 12D, 13C, 13D) are driven by the longitudinal movement of the cam plate (14), and respectively reach the end positions (12A1, 1261, 13A1, 1361) corresponding to the alignment of the guide rail (7) with the first route AB, or alternatively the shafts (12A, 12B, 13A, 13B) reach the end positions (12A2, 1262, 13A2, 1362) corresponding to the alignment of the guide rail (7) with the second route CD.

3. Mechanism according to claim 2, wherein in the end positions (12A1, 1261, 13A1, 1361), the rollers (12E, 12F) reach the extreme end positions in the grooves (10A, 10B) respectively corresponding to a lower value of Y in said grooves (10A, 10B), whereas the rollers (13E, 13F) reach the extreme end positions in the grooves (10C, 10D) respectively corresponding to a greater value of Y in said grooves (10C, 10D).

4. Mechanism according to claim 2, wherein in the end positions (12A2, 1262, 13A2, 1362), the rollers (12E, 12F) reach the extreme end positions in the grooves (10A, 10B) respectively corresponding to a greater value of Y in said grooves (10A, 10B), whereas the rollers (13E, 13F) reach the extreme end positions in the grooves (10C, 10D) respectively corresponding to a lower value of Y in said grooves (10C, 10D).

5. Mechanism according to claim 1, wherein the grooves (14A, 14B, 14C, 14D) of the cam plate (14) have at their final ends two semicircular-shaped notches (14A1, 1461, 14C1, 14D1) having a diameter slightly greater than the rollers (12C, 12D, 13C, 13D).

6. Mechanism according to claim 5, wherein when the rollers (12C, 12D, 13C, 13D) reach their extreme end positions in the grooves (14A, 14B, 14C, 14D) respectively, the rollers (12C, 12D, 13C, 13D) are mechanically fitted in the notches (14A1, 1461, 14C1, 14D1) respectively, the moving panel (6) therefore being mechanically locked in a secure manner in the alignment position for alignment of the guide rail (7) with the first route AB, or in the alignment position for alignment of the guide rail (7) with the second route CD.

* * * * *